US005544371A

United States Patent [19]

Fuller

[11] Patent Number: 5,544,371

[45] Date of Patent: Aug. 13, 1996

[54] BED PATIENT TURNING, LIFTING AND TRANSPORTING APPARATUS WITH MOBILE, FOLDING AND KNOCKDOWN FRAME

[76] Inventor: Carmel U. Fuller, Postal Rte. 1, Box 480, Haysi, Va. 24256

[21] Appl. No.: 46,889

[22] Filed: Apr. 13, 1993

[51] Int. Cl.[6] ..... A61G 7/10

[52] U.S. Cl. ..... 5/85.1; 5/88.1

[58] Field of Search ..... 5/85.1, 86.1, 88.1, 5/176.1, 620

[56] References Cited

U.S. PATENT DOCUMENTS

| | | | |
|---|---|---|---|
| 1,129 | 4/1839 | Fountain | 5/176.1 |
| 279,134 | 6/1883 | Comins | 5/176.1 |
| 752,198 | 2/1904 | Bratlie | 5/85.1 |
| 885,329 | 4/1908 | Ellis | 5/86.1 |
| 1,273,600 | 7/1918 | Floyd | 5/88.1 |
| 1,528,835 | 9/1922 | McCollough . | |
| 1,975,332 | 10/1934 | Rehkopf | 5/176.1 |
| 2,590,129 | 3/1952 | Sawaya | 5/176.1 |
| 2,603,851 | 7/1952 | Hawkins | 5/85.1 |
| 2,629,108 | 2/1953 | Wickey . | |
| 2,655,667 | 10/1953 | Burkert . | |
| 2,990,899 | 7/1961 | DeBella | 5/86.1 |
| 3,049,725 | 8/1962 | Bovre | 05/86.1 |
| 3,302,219 | 2/1967 | Harris . | |
| 3,383,717 | 5/1968 | Underwood . | |
| 4,109,329 | 8/1978 | Tupper . | |
| 4,379,051 | 8/1983 | Wheeler . | |
| 4,451,944 | 6/1984 | James . | |
| 5,068,931 | 12/1991 | Smith . | |
| 5,108,225 | 5/1991 | Frengi . | |
| 5,210,887 | 5/1993 | Kershaw . | |

FOREIGN PATENT DOCUMENTS

| | | | |
|---|---|---|---|
| 421107 | 2/1911 | France | 5/86.1 |
| 18736 | 11/1889 | United Kingdom | 5/176.1 |

*Primary Examiner*—Michael J. Milano
*Attorney, Agent, or Firm*—Donavon L. Favre

[57] ABSTRACT

A support frame is positioned over a hospital bed to assist in lifting and turning a patient on a sheet. The patient can also be lifted from the bed, the frame narrowed, and the patient transported to other locations in the hospital and then back to the bed without any severe physical handling.

2 Claims, 11 Drawing Sheets

Fig 20
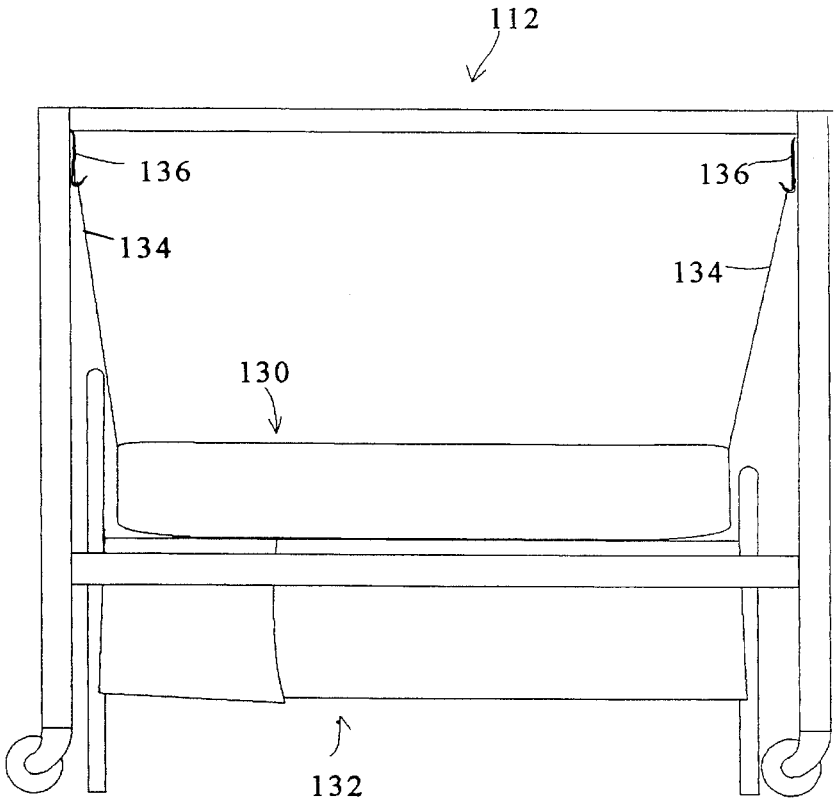
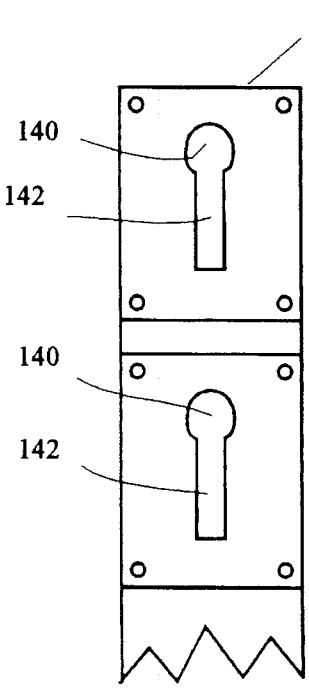
Fig 21
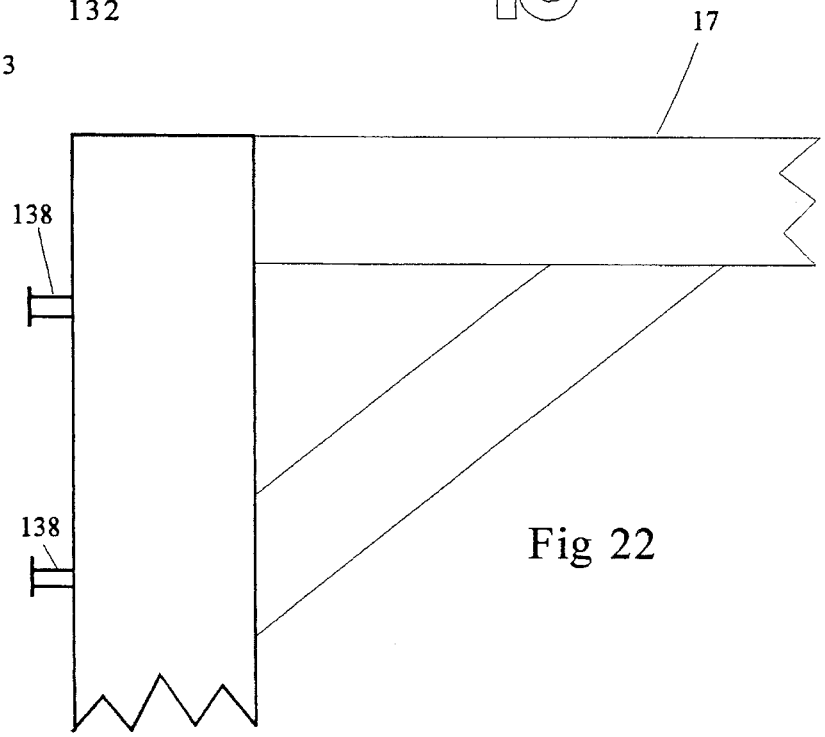
Fig 22

BED PATIENT TURNING, LIFTING AND TRANSPORTING APPARATUS WITH MOBILE, FOLDING AND KNOCKDOWN FRAME

BACKGROUND OF THE INVENTION

This invention relates to an apparatus for lifting, turning and transporting a person confined to a bed.

The need to lift, turn and transport invalids and other persons confined to a bed with temporary or permanent loss of mobility is well known. Lifting a helpless bed patient from the surface of a bed permits the changing of sheets and bed clothing and facilitates tending to the sanitary needs of the patient. Turning a patient at frequent intervals is needed to relieve pressure upon areas of the patient's body resting on the surface of the bed where bed sores are apt to occur. Manual lifting and turning of a bed patient is physically strenuous labor for nurses, aides and others responsible for the care of the patient. It often results in injury to the back and other body parts of the person doing the lifting and/or turning of the patient. These injuries to nurses, aides and others result in time lost from the job and greatly increased health care costs. Moving a patient from bed to stretcher to operating table and back again is also hard for the patient.

Most medical personnel who are trained to care for bed patients use a draw sheet upon which a patient rests to assist in turning the patient. By pulling on one side of the drawsheet, the nurse or aide can facilitate turning the patient with minimal physical contact with the patient. The act of pulling on the patient with a draw sheet is strenuous, especially when the patient is heavy, and injuries to the nurse or aide may still occur.

The need for mechanical means for lifting and turning a bed patient has long been recognized and various devices for performing the lifting and/or turning of a bed patient have been devised. The following patents are representative of the prior art:

| | | |
|---|---|---|
| 1,528,835 | | 3,383,717 |
| 2,603,851 | | 4,104,329 |
| 2,629,108 | | 4,397,051 |
| 2,655,667 | | 4,451,944 |
| 3,302,219 | | 5,018,225 |
| | 5,018,225 | |

The devices disclosed in the patents listed above may be categorized as: (1) apparatus attached to or combined with a bed for mechanically lifting and/or turning a bed patient and (2) apparatus including a mobile or stationary support frame which is positioned relative to a bed so that lifting or turning mechanism supported by the frame may be used to lift and/or turn a bed patient. U.S. Pat. Nos. 1,528,835, 2,629,108, 2,655,667, 3,383,717, 4,451,944 and 5,018,225 disclose devices representative of category (1). U.S. Pat. Nos. 2,603,851, 3,302,219, 4,109,329, 4,397,051 and 5,068,431 disclose devices representative of category (2).

SUMMARY OF THE INVENTION

The present invention is directed primarily to a bed patient turning, lifting and transporting apparatus having side frames and end frames wherein the end frames are variable in length so that the width of the apparatus can be reduced for movement through narrow passageways. Hinges are positioned in the end frames, making the end frames foldable so that the width of the end frames can be reduced.

Preferably the hinges are positioned on end frame members which are rigidly attached to the side frame members and extend a sufficient distance to render the apparatus stable and not top heavy and likely to tip over during movement. Preferably the rigidly attached end frame members extend perpendicularly from the side frame members by a distance of from six inches to eighteen inches on each side. In the alternative, rigid end frame members can have a telescoping section so that the width of the end frame members can be reduced for passage through a narrow passageway.

As alluded to above, the apparatus can be used to transport patients. A patient can be lifted by the apparatus and the apparatus moved away from the hospital bed. In order to prevent the patient from falling if the lifting straps fail, foldable shelves are supported at one end by hinges, and one or more braces are positioned on each side frame member to prevent the shelves from dropping below a horizontal position. Each brace is preferably pivotally mounted on a side frame member so that each brace can be rotated to a position parallel to a side frame when a side frame is positioned next to a hospital bed, and extended perpendicular to a side frame when the apparatus is moved from the bed and the shelves are folded down to a horizontal position.

The folding shelves are preferably used on an apparatus having variable length end frame members, but can also be used on other patient lifting and/or turning apparatus. Also applicable to any type of patient lifting and/or turning apparatus is a bath tub supported by the apparatus at the top and by a hospital bed at the bottom. A patient can be placed on patient support straps, the patient support straps attached to lifting straps and the patient lifted. The bath tub is then placed on the bed and the patient lowered into the bath tub.

In a preferred embodiment clamps are attached to the lifting straps and the clamps are attached to the sheet, replacing the lifting rods. The clamping surfaces of the clamps have plates having gripping rods attached to the plates. The clamps are made by taking conventional VISE GRIP sheet metal clamps having gripping plates and attaching gripping rods to the plates. The gripping surfaces are then rubber coated. The gripping rod or rods on one plate being parallel to and fitting between the gripping rod or rods on an opposing plate when the clamp is closed to provide a good gripping surface. The gripping rods are placed perpendicular to the tension created by lifting a patient on the sheet, or parallel to the edge of the sheet to which they are attached. The gripping clamps can be used on any type of patient lifting and turning apparatus utilizing lifting straps.

For lifting a patient from a sheet on a hospital bed, lifting rods on each side of the apparatus are attached to lifting straps on each side of the apparatus. Patient support straps are positioned under a patient and attached at each end to the lifting rods. The patient is then lifted for sheet changing, bathing, defecating, urinating, or movement to and from an operating room. An operation can be performed on the shelves of the apparatus reducing the movement required in surgery. For ease in lifting, a center patient support strap can be inserted first, the body raised and additional patient support straps inserted under the raised patient.

The patient support straps are preferably inserted under the patient using a pulling rod. The pulling rod has a gripping handle on one end a rod extending from the handle and a right angle bend at the other end for gripping a free loop on one end of a patient support strap. A loop on the opposite end of the patient support strap can permanently encircle one lifting rod. After the support strap in inserted under the patient, the free loop can encircle the other lifting rod. The lifting rod can be inserted through the loop or the loop, opened, placed around the lifting rod and then closed with snap fasteners, VELCRO fasteners, hooks and eyes or any other known type of fastener. The patient support straps can also be used in conjunction with the above described clamps using appropriately spaced gripping rods. For a sheet the opposed gripping rods are preferably spaced apart a distance approximately equal to the thickness of a sheet. For a strap, the opposed gripping rods are preferably spaced apart a distance approximately equal to the thickness of a strap.

The variable width apparatus has a bed cover comprising a sheet or disposable pad adapted to be placed between a patient and a bed. The cover has substantially opposing first and second side end and is capable of supporting the patient. First lifting and lowering means comprise a first electric motor, a first shaft driven by a gear train driven by the first motor. A plurality of first flat straps are attached at one end to the first shaft and at the other end to the first side of the cover. The operation of the first electric motor causes movement in the first shaft and in turn the lifting or lowering of the first side end of the bed cover to lift or turn a patient. A second bed cover lifting and lowering means comprises a second electric motor, a second shaft driven by a gear train driven by a second electric motor. A plurality of second flat straps are attached at one end to the second shaft and at the other end to the second side of the cover. The operation of the second electric motor causes movement in the second shaft and in turn the lifting or lowering of the second side end of the bed cover to lift or turn a patient. Independent control means for each motor provide that each set of straps can be raised or lowered independently of the other set of straps. The motors are preferably variable speed motors to provide for gentle treatment of a patient. The direct drive provides an assurance against patient fall due to motor disengagement.

The present invention also provides improved apparatus of category (2) referred to above which includes a mobile folding frame which may be easily disassembled-in-part so that the frame may be moved to and from a position straddling a bed with lifting and turning mechanism supported by the frame overlying the bed when the device is positioned to straddle the bed. A longitudinal frame member is attached to the frame by downwardly extending pins on each end of the longitudinal frame member. The pins mate with corresponding holes in horizontal brackets on the frame. When it is desired to move the frame from one longitudinal side of a bed to the other the horizontal frame member can be lifted from the frame, the frame moved the width of the bed and the longitudinal frame member replaced. The same result can be obtained by vertical slots in the frame mating with headed pins vertically attached to the horizontal frame member.

With the foregoing objects and features in view and such other objects and features as may become apparent as this specification proceeds, the invention will be understood from the following description taken in conjunction with the accompanying drawings wherein like characters of reference are used to designate like parts.

BRIEF DESCRIPTION OF DRAWINGS

FIG. 20 shows a bath tub resting on a bed and supported by chains suspended from hooks on the frame.

FIGS. 21 and 22 show a pin and slot arrangement for attaching an upper longitudinal frame member to a support post.

DETAILED DESCRIPTION OF THE PREFERRED EMBODIMENTS OF THE INVENTION

Figure 1:
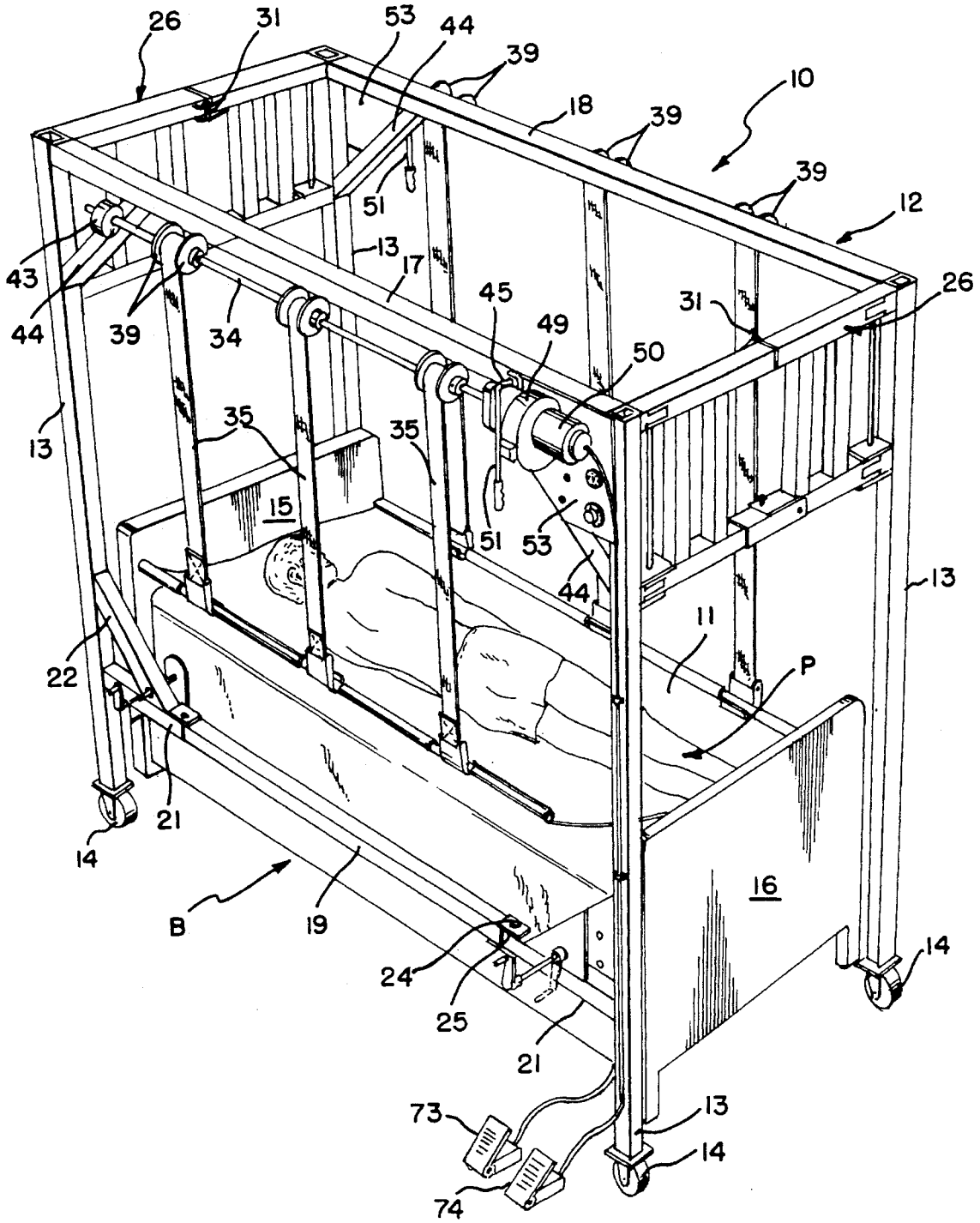
FIG. 1 is a perspective view of the apparatus of this invention shown straddling a hospital bed on which a patient is lying.

Referring now to the drawings and specifically to FIG. 1 an apparatus for lifting and turning a bed patient is generally indicated by the reference numeral 10. The apparatus 10 is shown in a position wherein it straddles a bed B on which a patient P is lying. A special sheet 11 is positioned on the surface of the bed under the patient P. The lifting and turning apparatus 10 includes an open frame 12, comprising four vertical posts 13 arranged at corners of a rectangle. Each post 13 is supported upon the floor F by a caster wheel 14 having suitable braking mechanism for locking the wheel against rotation when it is desired to maintain the frame in a stationary position and for unlocking the wheel when it is desired to move the frame. The posts 13 at each end of the frame 12 are spaced by a distance sufficiently greater than the width of the normal hospital bed so that the frame can be rolled longitudinally from one end of the bed to a position straddling the bed. Each end of the frame 12 between end posts must be open for a sufficient height above the floor so that the frame will not encounter the head and foot boards 15 and 16 respectively of the bed frame as it is rolled into position straddling the bed.

The left hand corner posts 13 on opposite ends of the frame 12 (looking forward from the foot of the frame toward the head as seen in FIG. 1) are connected by an upper longitudinal side frame member 17. Similarly the right hand corner posts 13 at opposite ends of the frame are connected by an upper longitudinal side frame member 18. The upper longitudinal side frame members 17 and 18 are preferably rigidly secured to the upper ends of posts 13 by welds or by other suitable rigid securing means.

Each of the corner posts 13 has a short horizontal tubular section 21 rigidly connected at one end to the post and extended perpendicularly therefrom toward the opposite end of the frame 12. Angle braces 22 extend between a side of each post 13 above the tubular horizontal section 21 and a position on the top side of the tubular horizontal section 21 outwardly from the post 13 and short of the free end of the horizontal section. The free end portion of the horizontal section outwardly of the angle brace 22 has a vertical hole 23 therethrough for receiving a removable pin or bolt 24.

Removable left and right hand, lower longitudinal side frame members 19 and 20, respectively, are connected between the short tubular sections 21 at opposite ends of the frame 12 by means of the pins 24. The lower side frame members 19 and 20 have flat plate-like extensions 25 at each of their ends offset upwardly from the top of the respective side frame members 19 and 20. The plate-like extensions 25 have a vertical hole 23 therein through which pin 24 extends downwardly. When the removable side frame members 19 and 20 are inserted between the short tubular sections 21 at opposite ends of the frame 12 and the pins 24 are inserted through the holes 23 in the short tubular sections, the ends of the side frame members 19 and 20 closely abut the free ends of the short tubular sections 21 to which they are connected, and the flat plate-like extensions 25 rest on top of the free end portions of the short tubular sections 21.

The vertical posts 13, at each end of the frame 12, are connected adjacent the tops of the posts by a folding transverse end frame assembly 26 of rectangular configuration. The folding transverse end frames 26 each comprise vertically spaced top and bottom rails 27 and 28 respectively, and a plurality of horizontally spaced vertical frame members 29 which are rigidly secured at their ends to the top and bottom rails. The ends of the top and bottom rails 27 and 28 at each end of the frame 12 are pivotally supported on the facing sides of the tubular vertical posts 13 by suitable hinges 20. The rails 27 and 28 are divided into two sections of equal length which are connected by centrally located hinges 31 which permit the transverse end frames 26 to fold transversely about vertical pivot pins 31. The pins 32 are removable from the leaves of hinges 31 in order that the frame 12, if desired, may be separated down the middle into right and left hand side frame sections to facilitate transportation or storage. The pins 32 are preferably tethered to respective rails 27 and 28 to prevent loss when they are pulled from the leaves of hinges 31.

Figure 8:
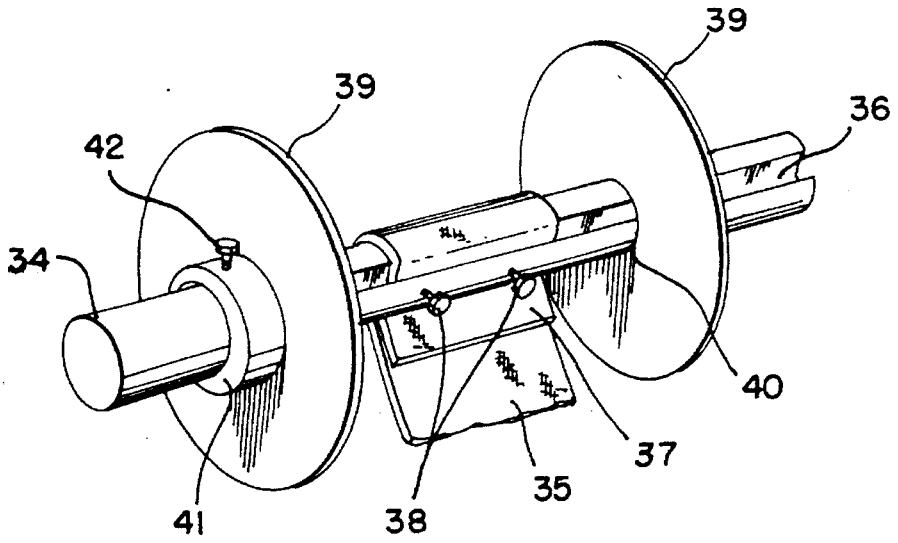
FIG. 8 is a perspective view showing a slotted windup shaft with one end of a lift strap secured therein.

A shaft 34 is mounted on each side of the frame 12 outwardly from and parallel to the upper longitudinal frame members 17 and 18. A plurality of straps 35 are mounted on each shaft 34 for winding and unwinding as the shaft is turned. The shaft 34 has longitudinal slots 36 formed therein at longitudinally spaced intervals. One end of each strap is inserted through a slot (FIG. 8) and is secured in the slot by screws 38 extending through one side of the shaft into the slot 36. Guide disks 39, each having a central opening 40 for receiving the shaft 34 and a collar 41 fixed thereon about the opening 40, are mounted on the shaft to act as guides for winding and unwinding the straps when the shaft is rotated. Each collar 41 is secured to the shaft 34 by a set screw 42 extending through the collar 41. There is a pair of the guide disks 39 mounted on the shaft 34 for each strap 35. The guide disks of each pair are separated by a distance slightly greater than the width of each strap so that the strap may be freely wound upon itself between the guide disks.

Figure 2:
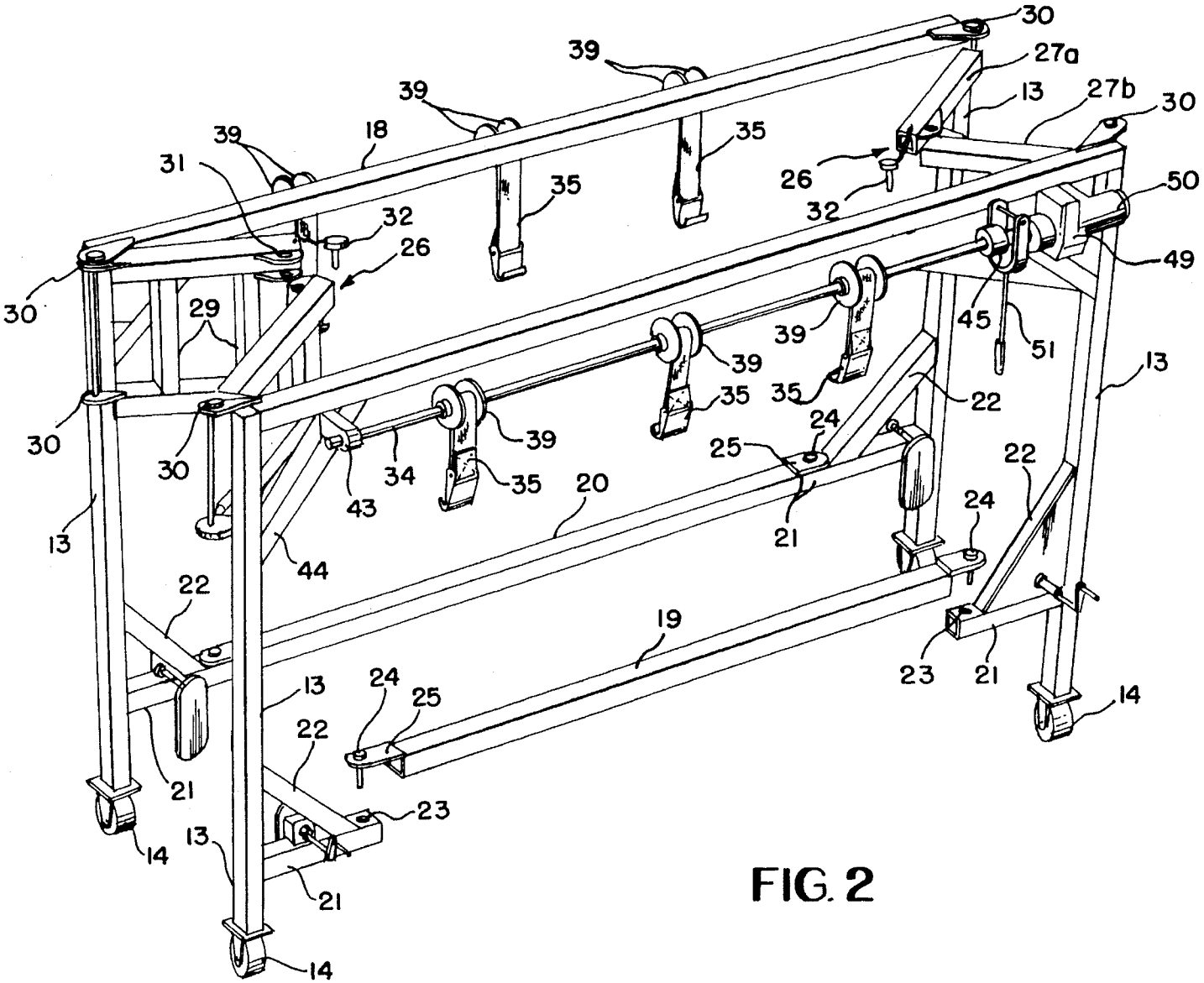
FIG. 2 is a perspective view of the invention shown in FIG. 1 but showing the apparatus removed from a position straddling a bed and with the end frames partially folded and certain frame elements disassembled.
Figure 4:
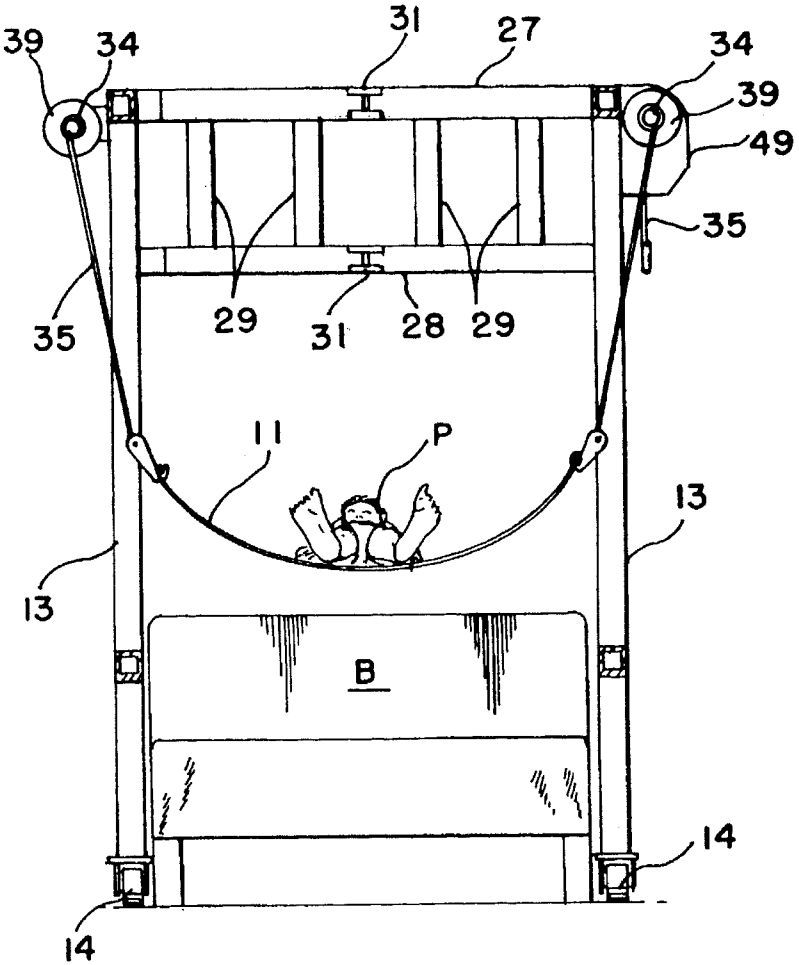
FIG. 4 is a vertical cross sectional view similar to FIG. 3 but showing both sides of the patient support sheet lifted to raise the patient above the surface of the bed.
Figure 3:
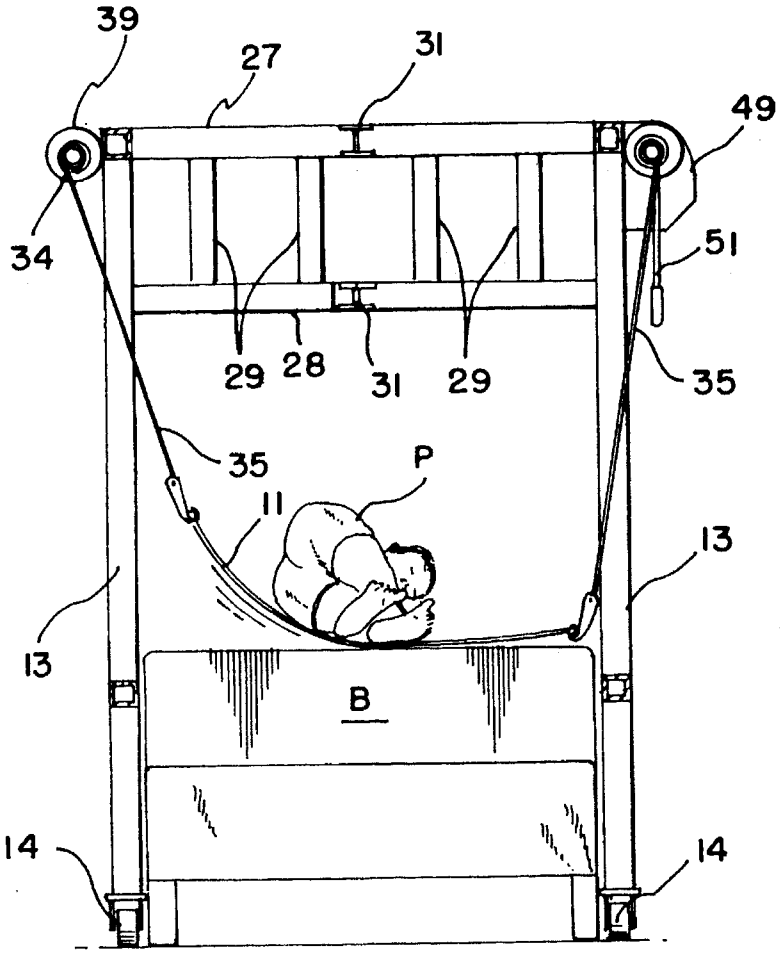
FIG. 3 is a vertical cross sectional view through the apparatus shown in FIG. 1 showing a bed patient resting on a special support sheet with one side of the sheet lifted to a position whereby the patient has been turned onto one side.
Figure 7:
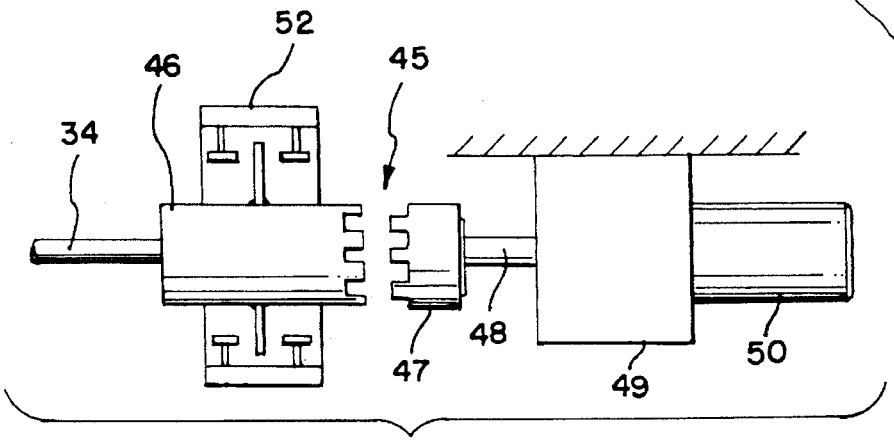
FIG. 7 is a top plan view of the clutch mechanism provided in the drive shaft of the lift strap windup mechanism.
Figure 9:
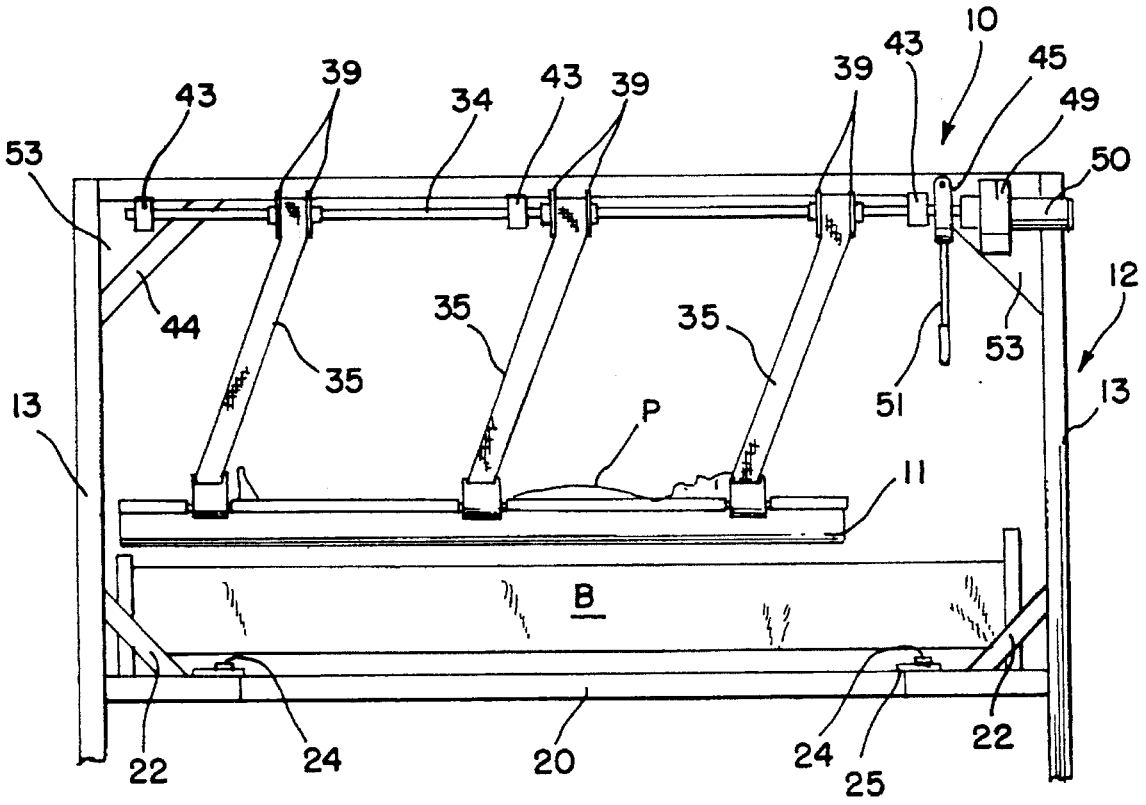
FIG. 9 is a side elevational view of the invention as it appears when a patient is being moved longitudinally in a bed.

One end of each shaft 34 is rotatably mounted in a bearing 43 supported by an angle brace 44 connected between a vertical post 13 and upper longitudinal frame member 17 as seen in FIG. 2. The other end of shaft 34 is keyed to one element 46 of disconnect clutch 45. A second element 47 of clutch 45 is fixed to the end of output shaft 48 projecting from speed reduction gearing 49. An electric motor 50 drives the speed reduction gearing 49 which in turn drives the shaft 48 and clutch element 47. Clutch element 46 is slidably keyed to the shaft 34 and is shifted from a position in engagement with clutch element 47 to a non-engaging position (as seen in FIG. 7) by means of the clutch actuating lever 51 which is forked at its upper end and is pivoted above the clutch housing 52 as seen in FIGS. 2 and 9. The clutch elements 46 and 47 are normally engaged so that the motor 50 drives the shaft 34 through the reduction gearing 49 and clutch 45.

The primary purpose of the clutch 45 is to disconnect the shaft 34 from the motor 50 and speed reduction gearing 49 so that the shaft may rotate freely to quickly unwind the straps 35 when it is desired to connect the straps 35 to the sheet 11 under the patient resting upon the bed B.

The mechanism, including the motors 50, reduction gearing 49 and clutches 45 for driving the shafts 34 on opposite sides of the frame 12 are located at opposite ends of the frame. The mechanism for driving the shaft 34 on the left hand side of the apparatus 10 is located at the foot end of the apparatus as seen in FIG. 1 and the mechanism for driving the shaft 34 on the right hand side of the apparatus 10 is located at the head end of the apparatus 10 as seen in FIG. 9.

Gusset plates 53 secured at the upper left and right hand corners of the frame 12 at the foot and head ends thereof respectively, provide support for the motors, reduction gearing and clutches as well as for motor control dials and switches.

Figure 10:
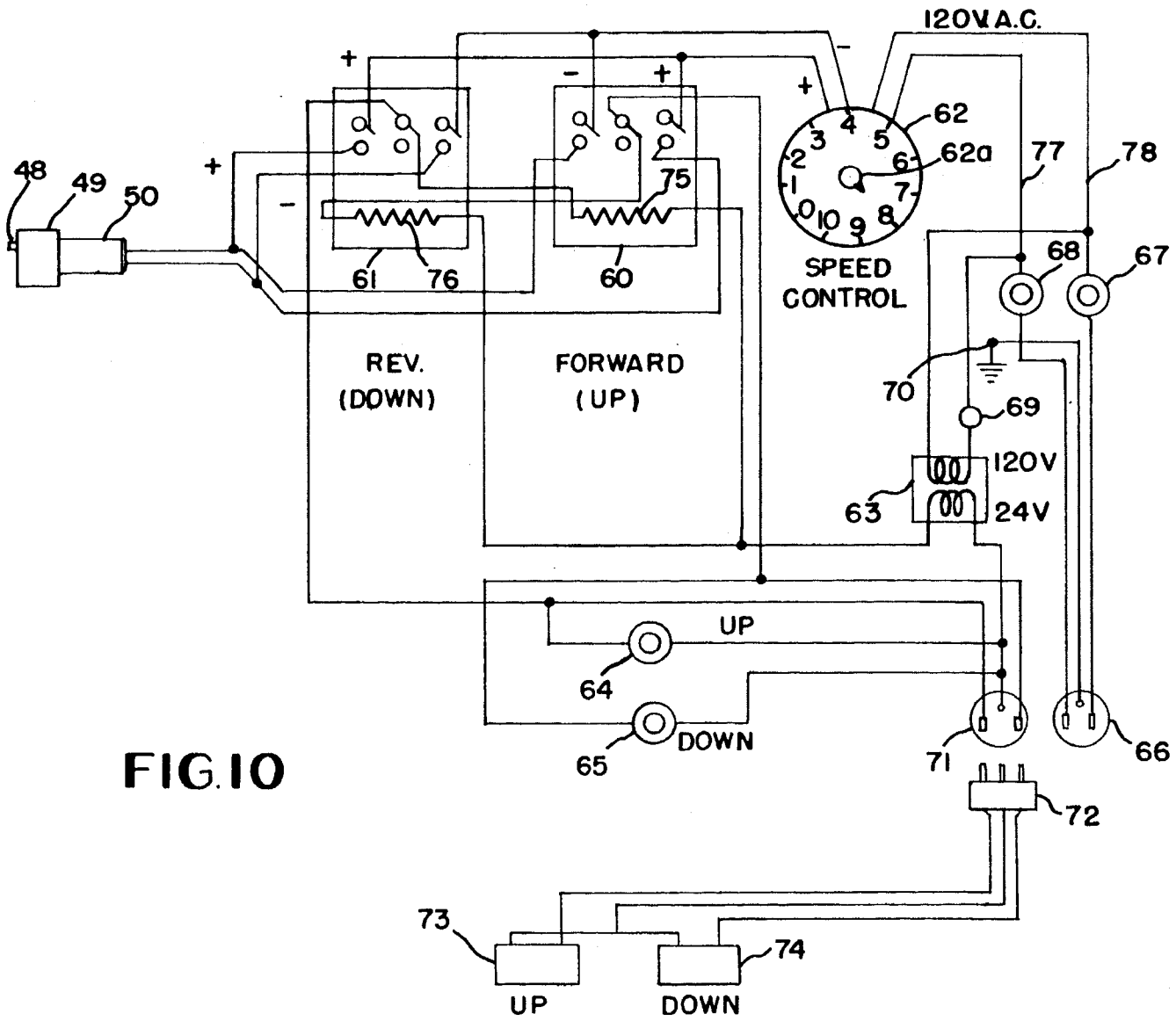
FIG. 10 is a schematic wiring diagram of the electrical components of the invention.

FIG. 10 illustrates the circuits for energizing and control of the reversible DC motors 50. Electric current is fed into the motor control circuit through a standard 120 v ac receptacle 66. The center line from receptacle 66 is grounded to the frame of apparatus 10 at 70. The outside lines 77 and 78 lead to a rectifier and speed control device 62. Fuses 67 and 68 are located in the lines 77 and 78 to protect against overload. DC current from the rectifier and speed control device 62 is fed through the forward and reverse switches 60 and 61 to the motor 50. The rectifier and speed control device 62 has a rotatable knob and pointer **62*a* which may be rotated to selected positions to control the speed of the motor 50**.

The forward and reverse switches 60 and 61 have actuating coils 75 and 76 respectively for actuating the switches when the coils are energized. The current for energizing the coils 75 and 76 is taken from across the ac lines 77 and 78 through a transformer 63 which reduces the 120 volt input to a 24 volt output. One side of each of the coils 75 and 76 is connected to one side of the output coil of transformer 63. The other sides of coils 76 and 77 are connected to a center contact of the forward or reverse switch that the respective coil does not energize. The center contacts of the forward and reverse switches are each connected through a separate momentary jog switch to the opposite side of the transformer 63. The up jog switch 64 when closed energizes the actuating coil 75 for the motor forward switch 60 thereby closing the forward switch 60 to cause motor 50 to rotate the shaft 34 for winding up the straps 35. When the down jog switch 65 is closed, the coil 76 for the reverse switch is energized to close the reverse switch 61 causing the motor 50 to reverse direction and to rotate the shaft 34 in a direction to unwind the straps 35.

The up and down jog switches 64 and 65 may be paralleled by up and down foot actuated switches 73 and 74 by connecting plug 72 into receptacle 71.

The jog switches 64 and 65, speed control knob 62*a* and dial 62*b*, fuses 67 and 68 are mounted on the panel 53 adjacent to the motor 50 with which they are associated along with other elements of the circuit shown in FIG. 10. The power input receptacle 66 and foot switch cable receptacle 71 are mounted in the plate 77 in the bottom corner of the frame 12 below the plate 53.

Figure 11:
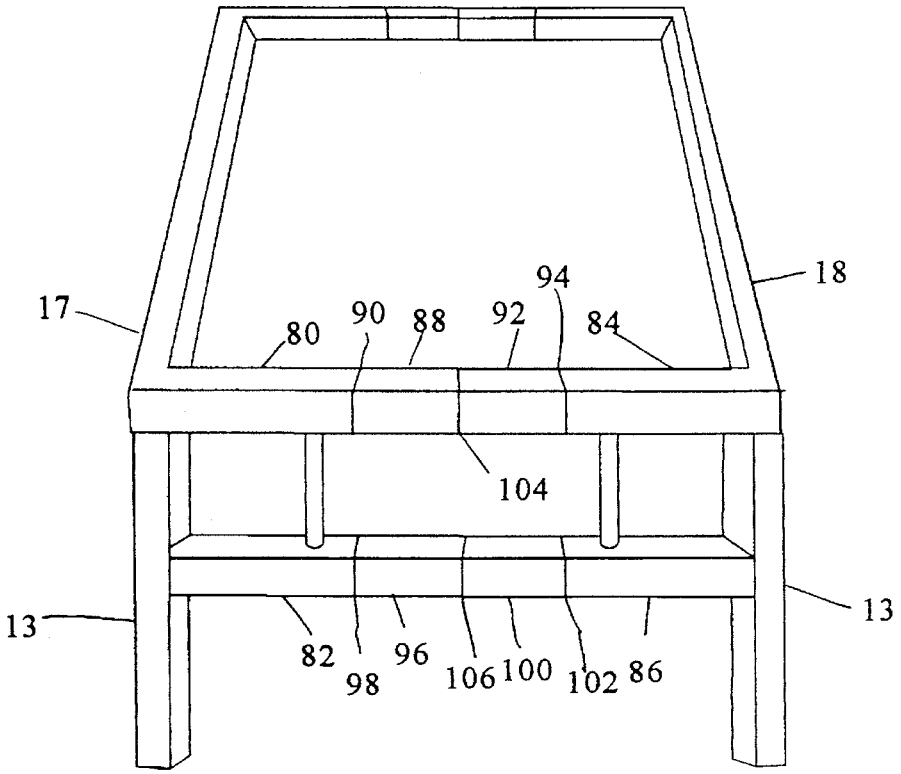
FIG. 11 shows a frame having a foldable center section to reduce the width of the frame.
Figure 12:
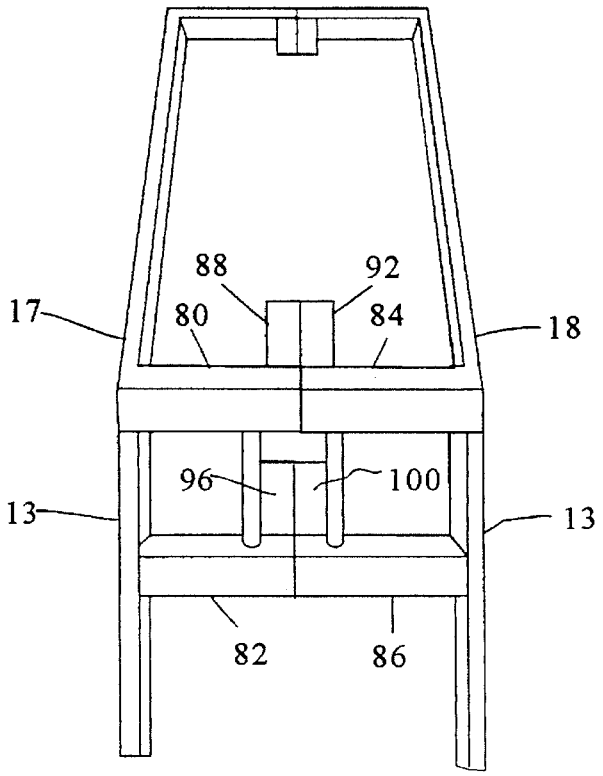
FIG. 12 shows the reduced width frame of FIG. 11.

Turning now to FIG. 11, a top end view of a folding mechanism which provides moving stability to the patient turning and lifting apparatus is shown. End frame members 80 and 82 are rigidly attached to horizontal and vertical frame members 17 and 13. End frame member 84 and 86 are rigidly attached to horizontal and vertical frame member 18 and 13 at the opposite side of the frame. Swinging frame members 88, 92, 96 and 100 are attached to rigid frame members 80, 84, 82 and 86 by hinges 90, 94, 98 and 102. When it is desired to move a patient to surgery, the patient is lifted from the hospital bed by the lifting mechanism, the frame carrying the lifted patient is moved from the bed, swinging frame members 88 and 92 joined by hinge 104 are swung together as are swinging frame members 96, and 100 joined by hinge 106. The reduced width frame is shown in FIG. 12. Only the top part of one end of the frame is shown in detail. The top part of the end of the frame not shown in detail is identical to the top part of the end shown. The parts of the frame not shown are identical to those shown in FIG. 1.

Figure 13:
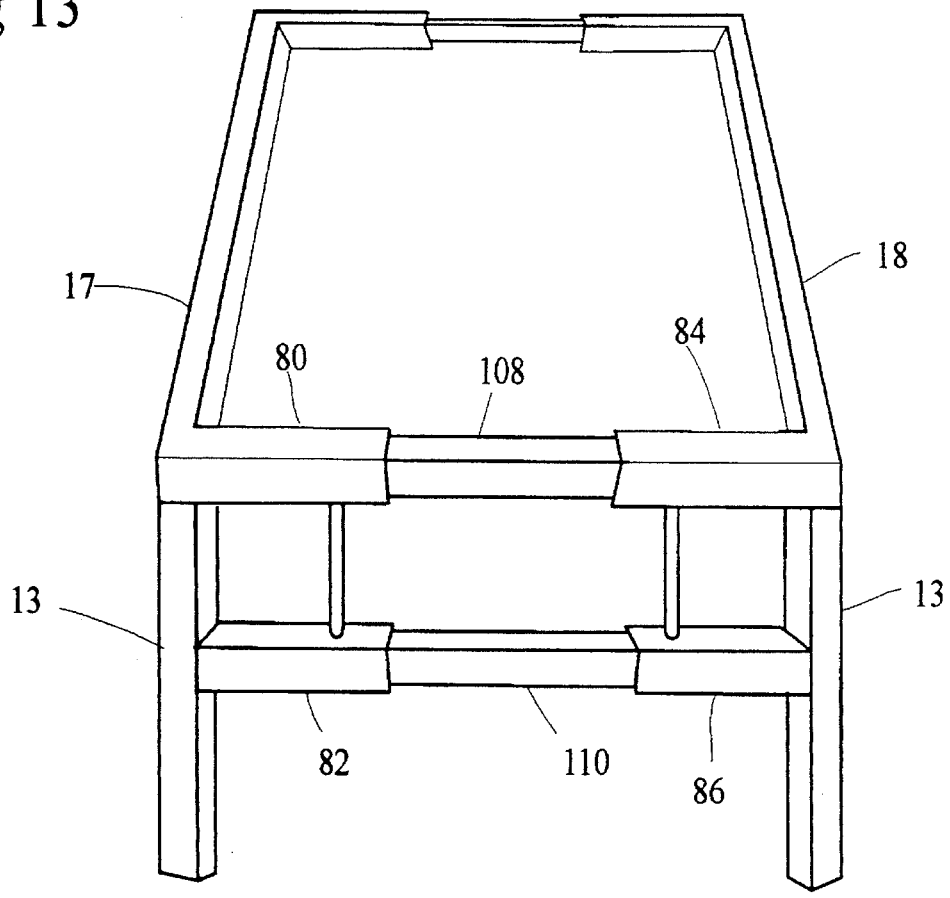
FIG. 13 shows a frame having a telescoping center section to reduce the width of the frame.

The frame shown in FIG. 13 is identical to the frame of FIG. 11 except that the swinging frame members 88, 92, 96 and 100 are replaced with sliding tubes 108 and 110. Tube 108 has exterior cross sectional dimensions corresponding to the interior cross sectional dimensions of rigid frame members 80 and 84. Tube 110 has exterior cross sectional dimensions corresponding to the interior cross sectional dimensions of rigid frame members 82 and 86. The width of the frame is reduced as is shown in FIG. 14 by sliding rigid frame members 80 and 84 over tube 108 and sliding rigid frame members 82 and 86 over tube 110.

Figure 14:
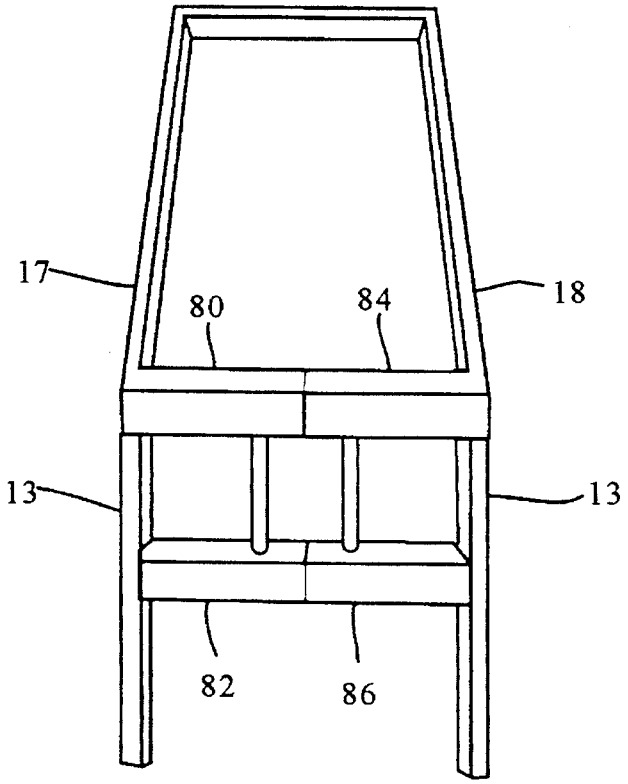
FIG. 14 shows the frame of FIG. 13 having a reduced width.
Figure 15:
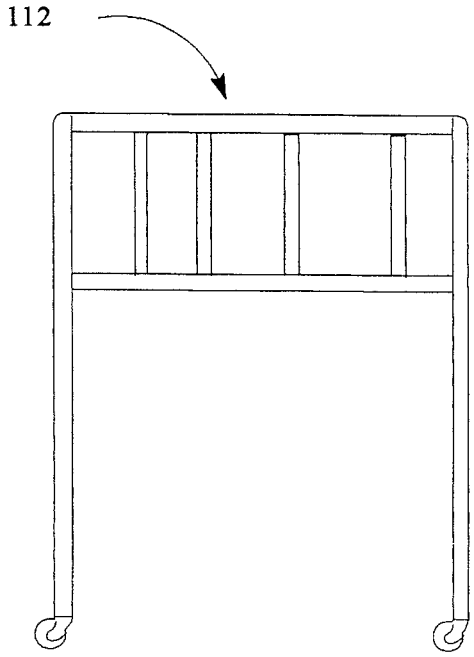
FIG. 15 is an end view of a frame with a padded support folded up and not shown.
Figure 16:
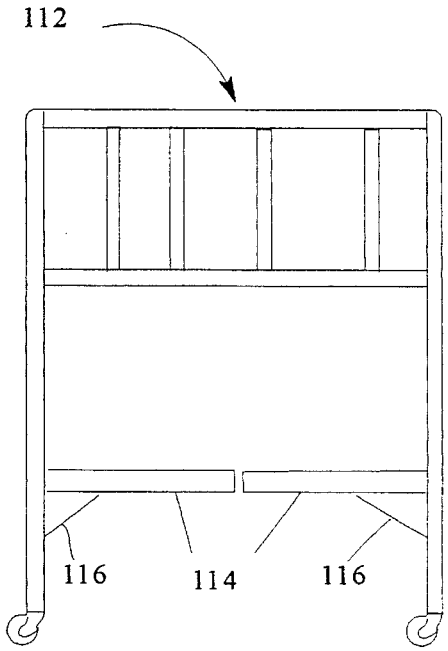
FIG. 16 is an end view of the frame showing the padded support folded down.
Figure 17:
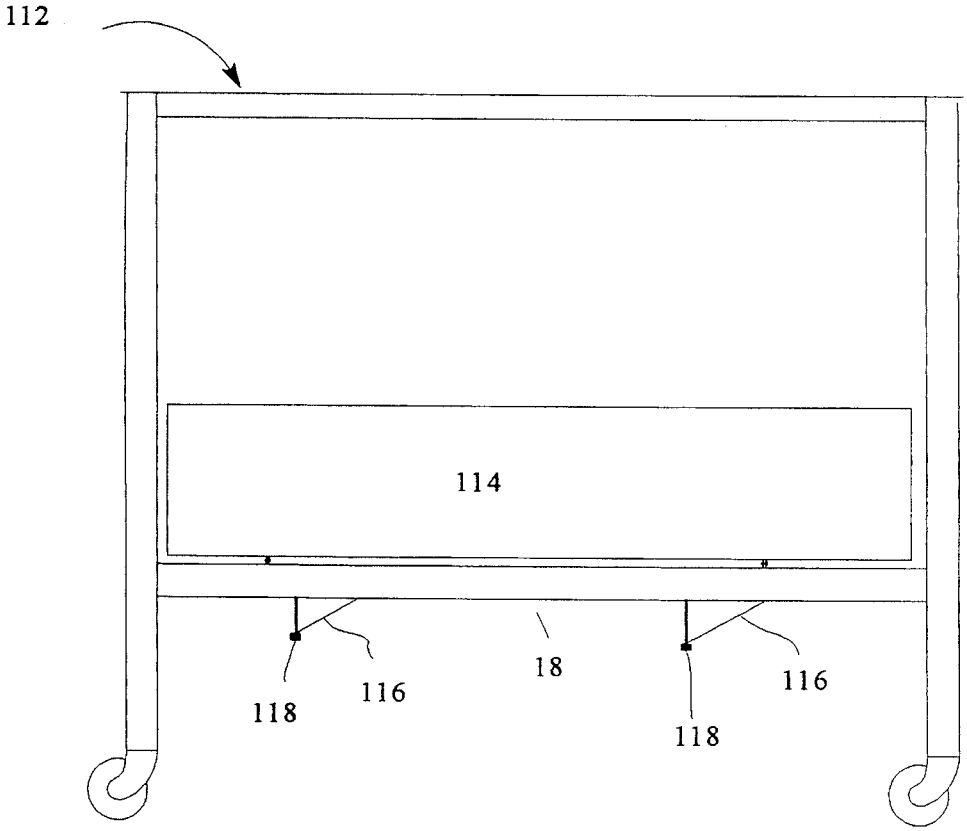
FIG. 17 is a side view of FIG. 15 showing the padded support.

When moving a patient with the reduced width frame of FIG. 12 or FIG. 14 it is preferred that a padded support be placed under the patient while moving to ensure that the patient is not dropped. A reduced width moving frame 112 of FIG. 12 or FIG. 14 is shown in FIGS. 15, 16 and 17. FIG. 15 is and end view of frame 112 with padded support 114 folded up so that frame 112 can be pushed over and around a hospital bed. The padded support 114 cannot be seen in FIG. 15 because it is folded up. Padded support 114 is shown folded down in FIG. 15 and supported by braces 116 which have been folded out away from their position parallel to lower longitudinal frame member 18 (see FIG. 17). Braces 116 are hinged on pins 118 which pins 118 are mounted on lower longitudinal frame member 18.

Figure 6:
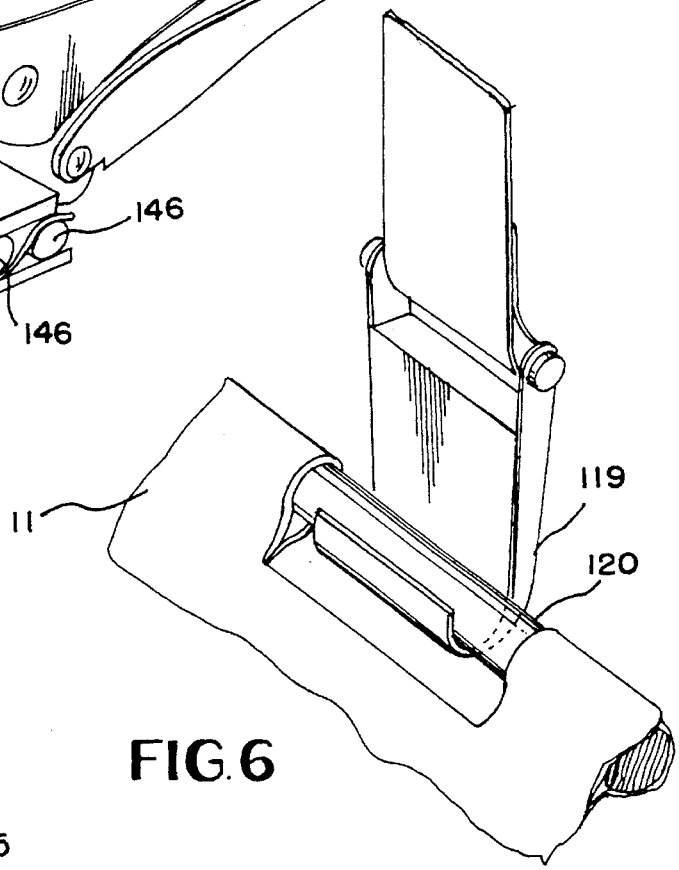
FIG. 6 is a partial perspective view similar to FIG. 1 but showing a hook attached to a lift strap with the hook engaged under a rod extending through an open tubular hem on one side of a special patient support sheet.
Figure 18:
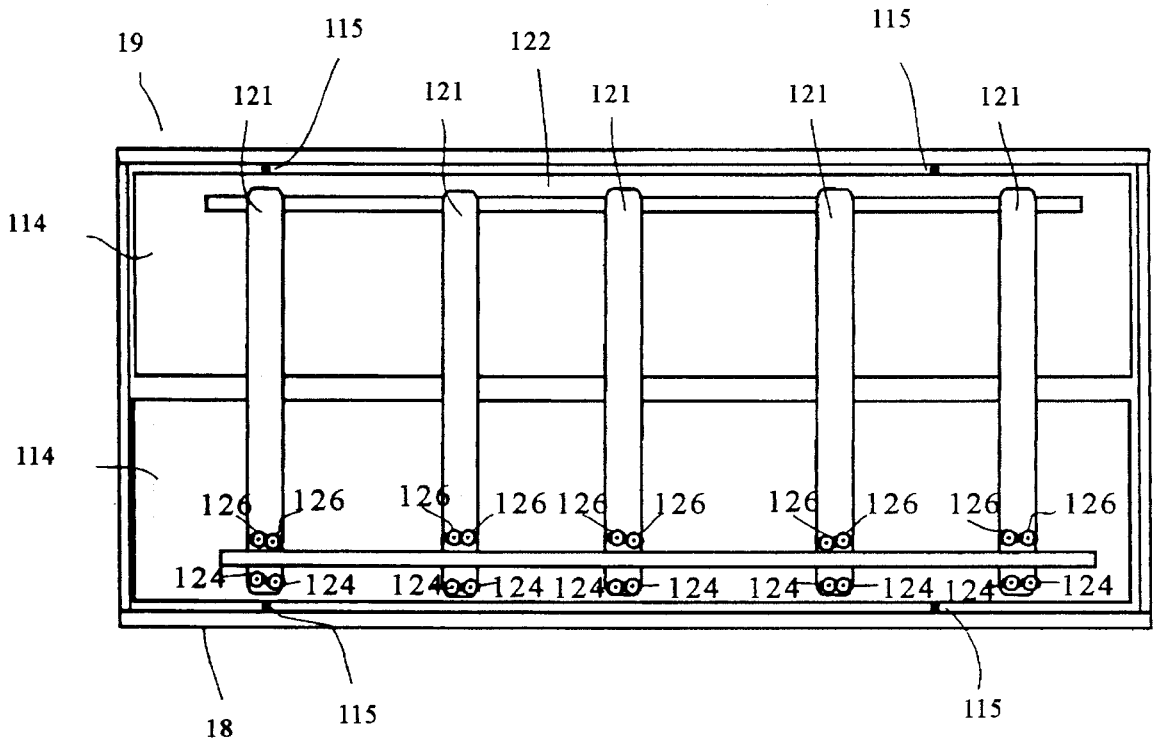
FIG. 18 is a top view showing patient support straps on the padded support.
Figure 19:
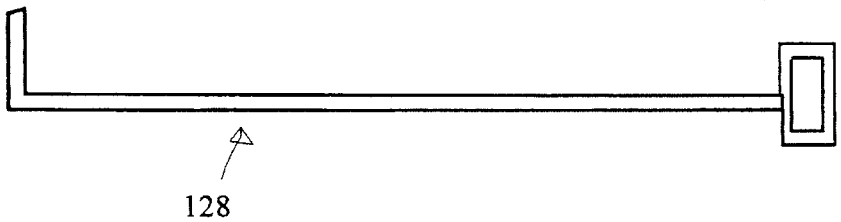
FIG. 19 shows the pulling rod used to pull the patient support straps under the patient.

FIG. 18 is a top view of FIG. 17 showing padded supports 114 attached to lower longitudinal frame members 18 and 19 by hinges 115. To place a patient on padded supports 114, the straps 35 which are used to manipulate sheet 11 are first disengaged. This is done by removing hooks 119 on the ends of straps from rods 120 on each side of sheet 11 (see FIG. 6). Patient support straps 121 are used to lift the patient. A fixed loop on one end of patient support straps 121 surround lifting rod 122. Upper snap fasteners 124 are snapped onto lower snap fasteners 126 to loop the other end of patient support straps 121 around pulling rod 128 which has been inserted under the lower back of the patient. Pulling rod 128 is then used to pull the end of the strap having the snap fasteners under the lower back of the patient. Snap fasteners 124 and 126 are disengaged, pulling rod 128 is removed and the end of the patient support strap having the snap fasteners is placed around lifting rod 122 and the snap fasteners are reengaged. The patient is then lifted using the same mechanism that was used to raise sheet 11. The remaining patient support straps 121 are then placed under the patient and attached to lifting rod 122 in like manner. The patient is then lifted from sheet 11 by patient support straps 121 and moved from the bed supported by frame 112. Padded supports 114 are then folded down into a horizontal position and braces 116 are swung out from frame 112 to support padded supports 114. The frame can be reduced in width as is shown in FIGS. 11, 12, 13 and 14. The patient is then lowered onto the padded supports 114 and can be then transported through narrow passageways for tests or even surgery while remaining on the padded supports 114. After tests or surgery, the patient can be returned to his bed, the process repeated in reverse order and the patient gently returned to his bed reducing strain on both patient and staff.

The patient can be lifted in like manner by patient support straps 121 and place in a bath tub 130 resting on bed 132. The bath tub 130 is suspended by chains 134 attached to hooks 136 on frame 112 (see FIG. 20).

FIGS. 21 and 22 show a easy way to construct to attach the upper longitudinal frame member 17 to support post 13. Headed pins 138 on longitudinal frame member 17 are inserted into openings 140 in support post 13 then lowered into narrow slots 142. Support post 13 is turned 90 degrees to show the openings.

Figure 5:
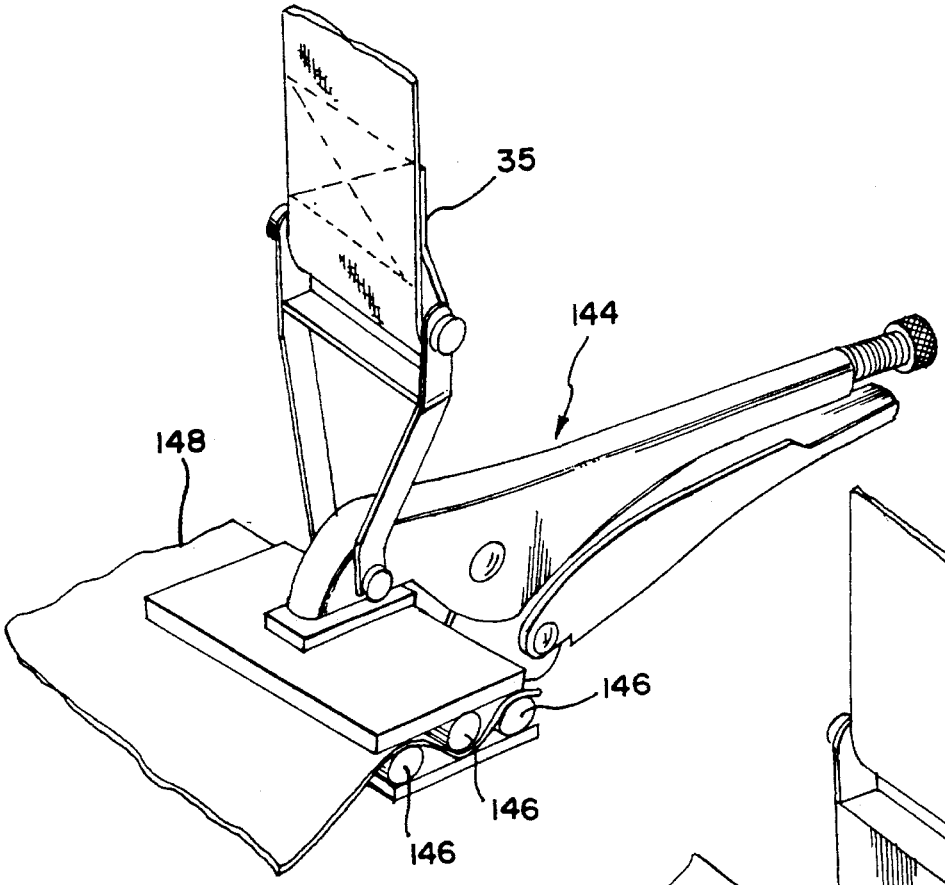
FIG. 5 is a perspective view of a vise type grip clamp supported by a lifting strap and clamped to one edge of a bed sheet.

An alternative sheet gripping device is shown in FIG. 5. A convention sheet metal VISE GRIP type locking clamp 144 is attached to strap 35. Rods 146 are welded to the plates of sheet metal gripping device to improve the grip of the device on bed sheet 148. The rods 146 and plates are coated with rubber to prevent slippage of the bed sheet through the gripping device.

While specific embodiments of the invention have been described, other modifications are included within the scope of the invention. For example the controls for lifting and turning can be hand controls so that a patient can control turning over if no attendant is available, or control lifting for bowel movement or urinating as is shown in FIG. 1 of U.S. Pat. No. 1,528,835 of McCollough, the disclosure of which is hereby incorporated by reference. The use of the ratchet of FIG. 9 as a fail safe lock in the present invention is also hereby incorporated by reference. The sheet opening for bowel movement shown in FIG. 2 and described at col. 2, lines 30 through 36 of U.S. Pat. No. 2,665,667 is also hereby incorporated by reference. Suspending a patient in a net instead of on a sheet for ventilation, washing or bathing as disclosed in U.S. Pat. No. 4,109,329 Tupper (1978) at col 6, lines 62 and 63, col 8, lines 13–15 and col 9, lines 25–28 is also hereby incorporated by reference. The power cord can be run through the frame members of the frame to reach from one side to the other.

What is claimed is:

1. A bed patient turning and lifting apparatus having side frames and end frames wherein the improvement comprises the end frames being variable in length so that the width of the apparatus can be reduced for movement through narrow passageways, hinges are attached to the side frames, foldable padded supports are supported by the hinges, and a brace is positioned on the side frames to prevent the foldable padded supports from dropping below a horizontal position, whereby the foldable padded supports can be folded down from a vertical position to a horizontal position when it is desired to remove a patient from a bed and to transport the patient.

2. The apparatus of claim 1 wherein each brace is pivotally mounted on the frame so that each brace can be rotated to a position parallel to a side frame when a side frame is positioned next to a hospital bed.

* * * * *